US007086951B2

(12) United States Patent
Chang

(10) Patent No.: US 7,086,951 B2
(45) Date of Patent: Aug. 8, 2006

(54) NUNCHAKU

(76) Inventor: Kuo Chi Chang, No. 8, Lane 184, Sung Chiang Rd., Taipei (TW)

( * ) Notice: Subject to any disclaimer, the term of this patent is extended or adjusted under 35 U.S.C. 154(b) by 73 days.

(21) Appl. No.: 10/896,034

(22) Filed: Jul. 22, 2004

(65) Prior Publication Data

US 2006/0019754 A1 Jan. 26, 2006

(51) Int. Cl.
*F41B 15/02* (2006.01)
*A63B 15/00* (2006.01)

(52) U.S. Cl. ..... 463/47.5; 482/83; 482/82; 59/95

(58) Field of Classification Search ..... 482/82, 482/83, 47.2, 47.5; 59/95; 403/78
See application file for complete search history.

(56) References Cited

U.S. PATENT DOCUMENTS 1,594,930 A * 8/1926 Davis ..... 59/95
2,466,243 A * 4/1949 Johnson ..... 59/95
2,633,375 A * 3/1953 Wilcoxon ..... 403/6
4,023,803 A * 5/1977 Lewis ..... 463/47.5
4,101,123 A * 7/1978 Anthony ..... 482/82
4,136,866 A * 1/1979 Bouvier ..... 482/82
5,054,772 A * 10/1991 Winston ..... 482/82
5,524,886 A * 6/1996 Kim ..... 463/47.5
5,893,800 A * 4/1999 Taggart ..... 463/47.5
6,126,292 A * 10/2000 Liu ..... 362/102
6,551,222 B1 * 4/2003 Beaver ..... 482/82
6,887,188 B1 * 5/2005 Davies ..... 482/82
2004/0002408 A1 * 1/2004 Rigas ..... 482/82

* cited by examiner

*Primary Examiner*—Gregory L. Huson
*Assistant Examiner*—Victor K. Hwang
(74) *Attorney, Agent, or Firm*—Troxell Law Office, PLLC

(57) ABSTRACT

A nunchaku includes a joint pin for connecting a baton of the nunchaku to a chain. The joint pin includes a front section for extending through a bearing mounted inside the baton to project from an inner end of the baton to connect to the chain, and a circular flange provided at a rear end of the joint pin to abut against an inner side of the bearing. The flange of the joint pin has an outer diameter larger than an inner bore of the bearing and therefore effectively prevents the whole joint pin and accordingly the chain from separating from the baton even when the steel balls of the bearing are badly worn off and fail to engage with the joint pin.

2 Claims, 5 Drawing Sheets

NUNCHAKU

FIELD OF THE INVENTION

The present invention relates to a nunchaku, and more particularly to a nunchaku having a joint pin that ensures secure connection of a baton of the nunchaku to a chain without the risk of unexpected separation of the baton from the chain.

BACKGROUND OF THE INVENTION

FIGS. 1, 2, and 3 illustrates a joint pin 3 for connecting a baton 5 of a nunchaku to a chain 1 via a bearing 2 mounted in an end of the baton 5. The joint pin 3 is provided at a predetermined position with an annular groove 31 about 10 mm in depth. The joint pin 3 has an outer diameter close to an inner bore 21 of the bearing 2, and could therefore be extended through the bore 21 of the bearing 2 to project from the end of the baton 5 to rotatably connect to an end of the chain 1. Steel balls 22 mounted in the inner bore 21 of the bearing 2 are engaged with the annular groove 31 on the joint pin 3, allowing the baton 5 to smoothly rotate relative to the joint pin 3 and the chain 1 when the baton 5 is thrown or otherwise manipulated. The above-structured nunchaku necessitates the steel balls 22 of the bearing 2 to have a high friction coefficient and considerably high frequency of use to therefore subject to wear, that constantly reduces an outer diameter of the steel balls 22 to cause gaps between the steel balls 22 and the annular groove 31 of the joint pin 3. The gaps gradually increase with the use of the nunchaku and the steel balls 22 would eventually fail to effectively engage with the joint pin 3 via the annular groove 31. Under this condition, it is very possible for the joint pin 3 to disengage from the bearing 2, resulting in unexpected and dangerous separation of the baton 5 from the chain 1 while it is thrown outward. It is therefore desirable to improve the conventional nunchaku to eliminate such problems.

SUMMARY OF THE INVENTION

A primary object of the present invention is to provide a nunchaku that is safer and more reliable for use without adversely affecting its simple structure, designed function, and easy assembling.

To achieve the above and other objects, the nunchaku of the present invention includes an improved joint pin for connecting a baton of the nunchaku to a chain.

The joint pin includes a front section for extending through a bearing mounted inside the baton to project from an inner end of the baton to connect to the chain, and a circular flange provided at a rear end of the joint pin to abut against an inner side of the bearing. The flange of the joint pin has an outer diameter larger than an inner bore of the bearing and therefore effectively prevents the whole joint pin and accordingly the chain from separating from the baton even when the steel balls of the bearing are badly worn off and fail to engage with the joint pin.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 9:
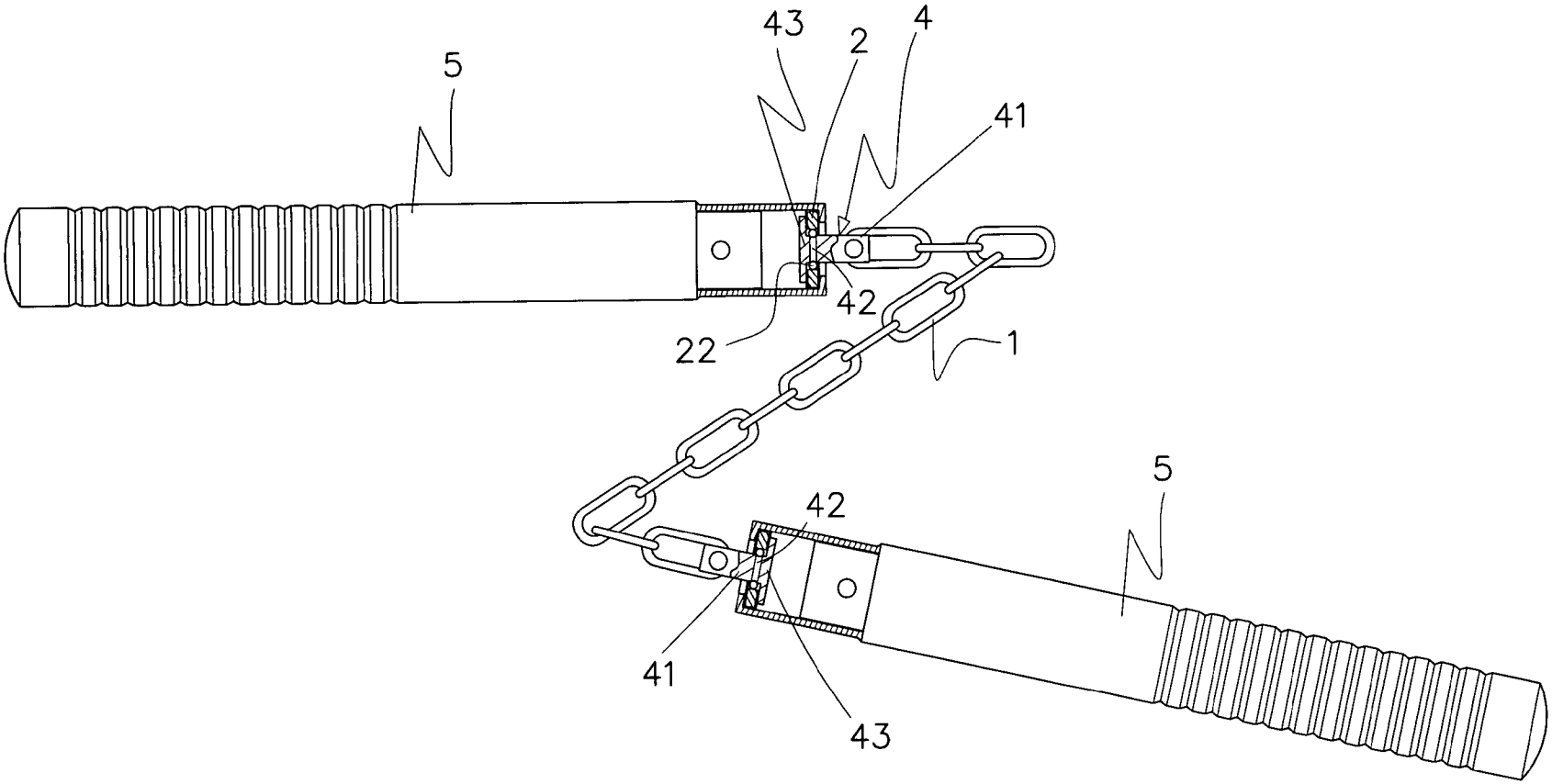
FIG. 9 is a partially sectioned perspective view of the nunchaku of the present invention.

Please refer to FIG. 9 that shows a nunchaku according to the present invention. As shown, the nunchaku includes two batons 5 connected end to end via a chain 1. Each of the two batons 5 is connected at an inner end to an end of the chain 1 via a bearing 2 mounted inside the inner end of the baton 5 and a joint pin 4 rotatably connected to the bearing 2 and projected from the inner end of the baton 5.

Figure 1:
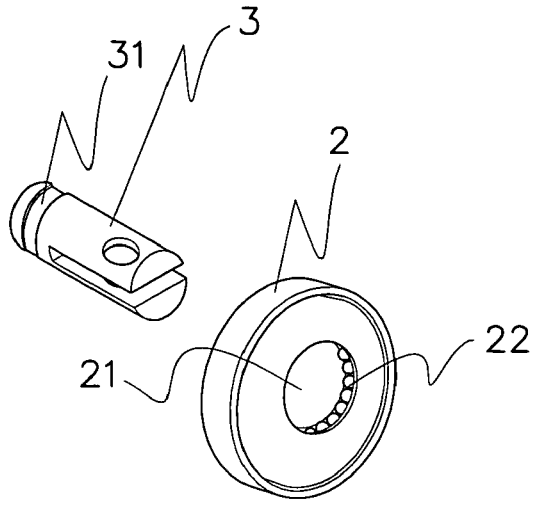
FIG 1 PRIOR ART
FIG. 1 is an exploded perspective view showing a joint pin and a bearing for a conventional nunchaku.
Figure 2:
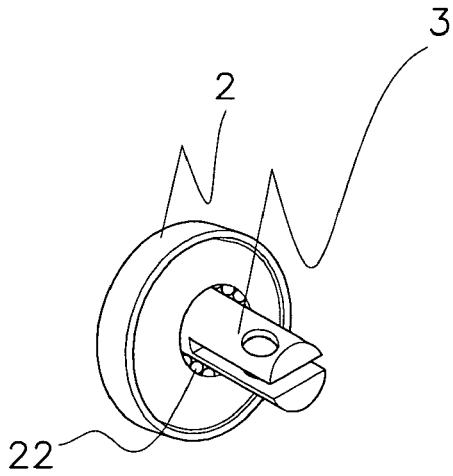
FIG 2 PRIOR ART
FIG. 2 is an assembled perspective view of FIG. 1.
Figure 3:
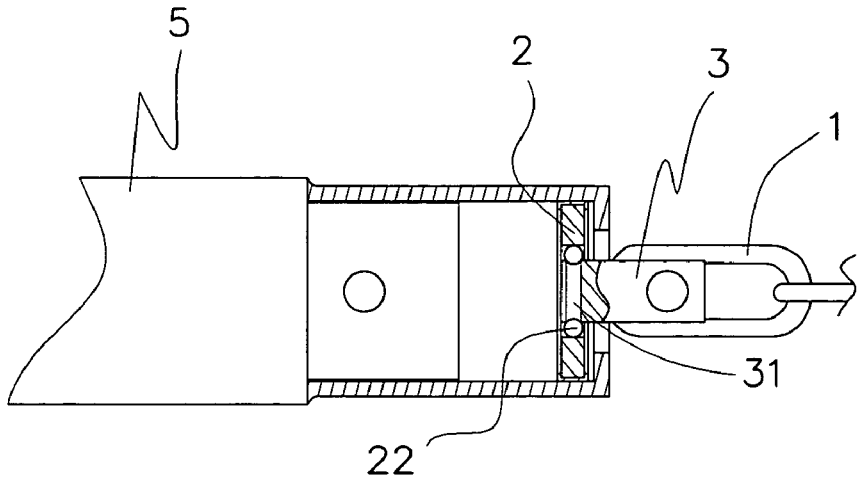
FIG 3 PRIOR ART
FIG. 3 is a fragmentary, partially sectional view of a conventional nunchaku showing the connected joint pin and bearing of FIG. 1.
Figure 4:
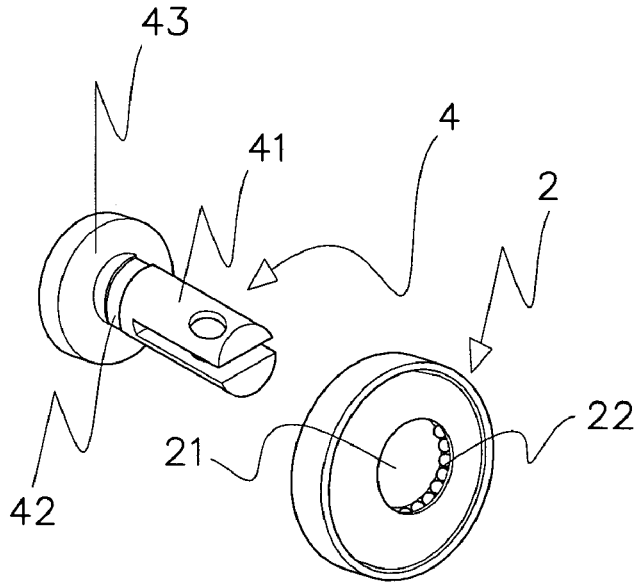
FIG. 4 is an exploded perspective view of a joint pin and a bearing for a nunchaku according to the present invention.
Figure 5:
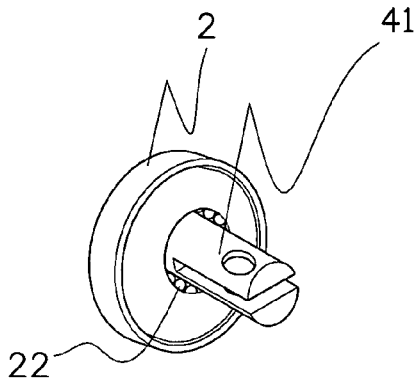
FIG. 5 is an assembled perspective view of FIG. 4.
Figure 6:
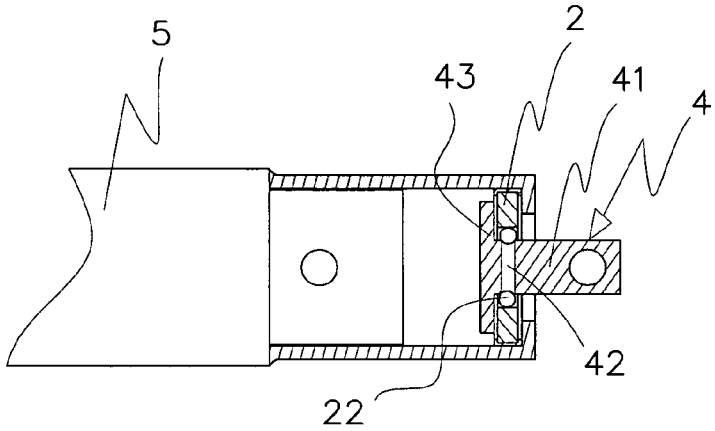
FIG. 6 is a fragmentary, partially sectional view of a nunchaku of the present invention showing the connected joint pin and bearing of FIG. 4.
Figure 7:
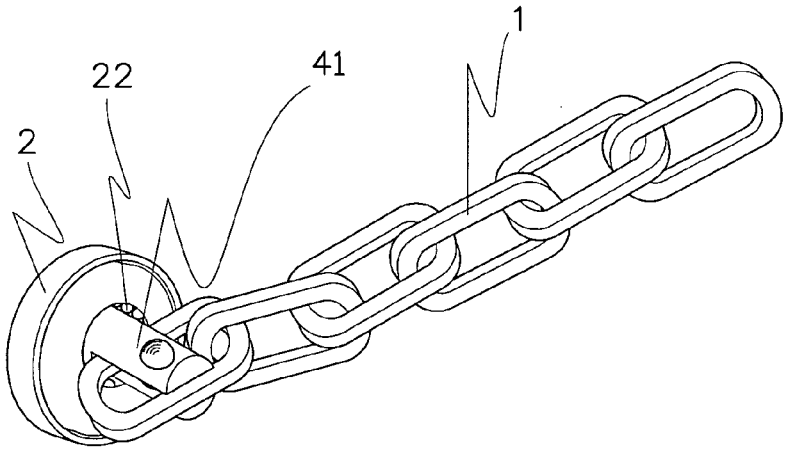
FIG. 7 is a perspective view showing the connection of the joint pin and the bearing of the nunchaku of the present invention to a chain.
Figure 8:
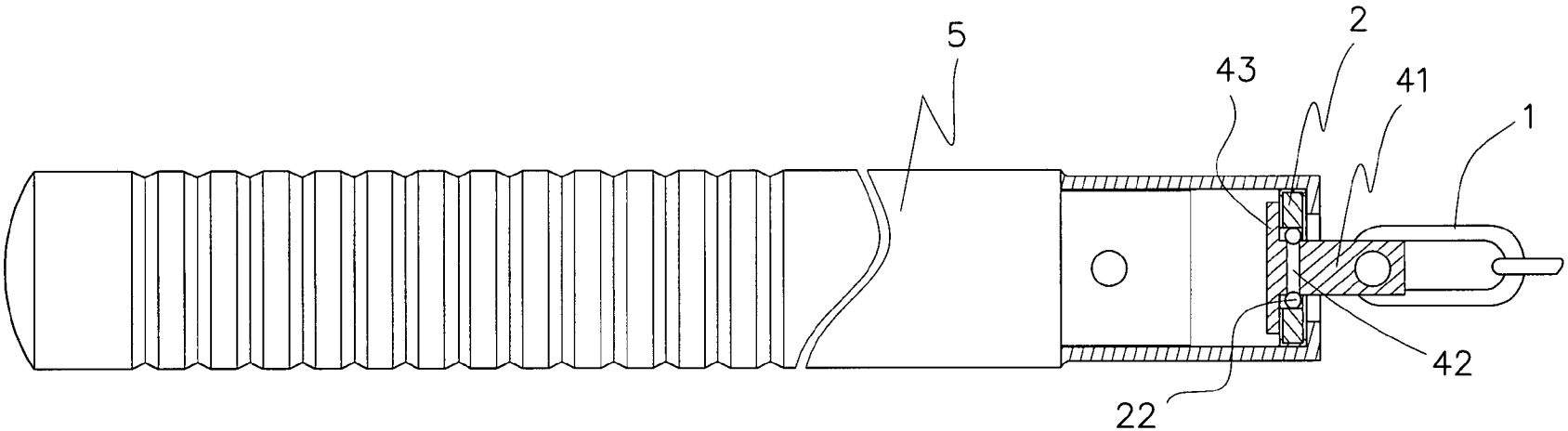
FIG. 8 is a fragmentary, partially sectioned view of a baton for the nunchaku of the present invention showing the connection of the joint pin and the bearing to a chain.

Please refer to FIGS. 4, 5, and 6 at the same time. The joint pin 4 includes a front section 41, an annular groove 42 provided near a rear part of the front section 41, and a circular flange 43 provided at a rear end of the joint pin 4 close to the annular groove 42. The bearing 2 has an inner bore 21 close to an outer diameter of the front section 41 of the joint pin 4, so that the front section 41 of the joint pin 4 could be extended through the inner bore 21 of the bearing 2 to project from the inner end of the baton 5 with the flange 43 abutted on an inner side of the bearing 2 and the annular groove 42 engaged with a plurality of steel balls 22 rotatably seated in the inner bore 21 of the bearing 2. The front section 41 of the joint pin 4 projected from the inner end of the baton 5 is then rotatably connected to an end of the chain 1, as shown in FIGS. 7 and 8.

The flange 43 has a thickness about 0.1 cm, and an outer diameter about 0.5 cm larger than the inner bore 21 of the bearing 2. Therefore, the flange 43 abutted on the inner side of the bearing 2 could absolutely safely prevent the whole joint pin 4 from moving out of the bearing 2 to dangerously separate from the baton 5.

When the chain or anyone of the batons 5 of the nunchaku of the present invention is thrown or otherwise manipulated in any manner to pull the joint pin 4, the flange 43 of the joint pin 4 connecting the baton 5 to the chain 1 is always abutted against the inner side of the bearing 2, even if the steel balls 22 of the bearing 2 have been badly worn off to lose their function of engaging with the annular groove 42 of the joint pin 4.

What is claimed is:

1. A nunchaku comprising:

a) two batons, each of the two batons having:

i) a bearing located at a connection end thereof and having an inner bore and a plurality of steel balls; and ii) a joint pin rotatably connected to the bearing and having a front section, an annular groove, and a circular flange having a disc shape, the front section protrudes through the inner bore of the bearing, the plurality of steel balls protrude into the annular groove, the annular groove is located between the front section and the circular flange, the circular flange engaging an inner surface of the bearing; and b) a chain connected at one of two opposing ends thereof to one joint pin of each of the two batons.

2. The nunchaku according to claim 1, wherein the circular flange has an outer diameter larger than an inner diameter of the inner bore.

* * * * *